United States Patent [19]

Arcouette

[11] Patent Number: 5,042,416

[45] Date of Patent: Aug. 27, 1991

[54] ONE-BOATER WATERCRAFT

[76] Inventor: Pierre Arcouette, R.R. 3, Route 243, Mansonville, Canada, J0E 1X0

[21] Appl. No.: 522,728

[22] Filed: Jun. 18, 1990

[51] Int. Cl.[5] ..... B63B 35/71

[52] U.S. Cl. ..... 114/347; 114/56; 114/357

[58] Field of Search ..... 114/56, 347, 351, 355, 114/356, 357, 358, 360, 363; 441/129, 130; 297/396, 284

[56] References Cited

U.S. PATENT DOCUMENTS

| | | | |
|---|---|---|---|
| 883,588 | 3/1908 | Thatcher | 114/347 |
| 3,150,386 | 9/1964 | Bastien . | |
| 3,324,488 | 6/1967 | Schulz, Jr. . | |
| 3,497,887 | 3/1970 | Bureau, Jr. . | |
| 3,649,977 | 3/1972 | Grabenauer . | |
| 3,665,532 | 5/1972 | Simpson | 114/355 |
| 4,407,216 | 10/1983 | Masters . | |
| 4,480,579 | 11/1984 | Masters . | |
| 4,564,240 | 1/1986 | Thieme | 441/129 |
| 4,589,365 | 5/1986 | Masters . | |
| 4,660,490 | 4/1987 | Broadhurst . | |
| 4,727,821 | 3/1988 | Masters . | |
| 4,823,717 | 4/1989 | Roberson | 114/61 |
| 4,825,799 | 5/1989 | Bergeron et al. | 114/351 |

FOREIGN PATENT DOCUMENTS

| | | | |
|---|---|---|---|
| 1082051 | 7/1980 | Canada | 114/347 |
| 1084347 | 8/1980 | Canada . | |
| 49693 | 4/1982 | European Pat. Off. | 114/357 |
| 806099 | 6/1951 | Fed. Rep. of Germany | 114/347 |
| 2301658 | 7/1974 | Fed. Rep. of Germany | 114/355 |
| 610710 | 6/1978 | U.S.S.R. | 114/347 |

*Primary Examiner*—Sherman Basinger
*Assistant Examiner*—Thomas J. Brahan

[57] ABSTRACT

The watercraft is designed to be used by poor swimmers and to be propelled by a double paddle in a leisurely way. The hull forms lateral stabilizing floatation bulges and a central fully-open cockpit providing a high back-rest and a seat followed by an inverted V-shape portion for supporting the boater's lower limbs in a semi-flexed condition. The forward part of the V-shape portion is provided with a central upwardly-extending rib, also protruding from the forward wall of the cockpit to provide a separation extending between the legs and feet, the feet being laterally confined at the foot-rest by the rib and the side walls of the cockpit. There is further provided a triangular flap member pivoted to the top of the cockpit at its back to form a steeper back-rest when pivoted within the cockpit and a more-inclined back-rest extension when pivoted over the deck.

7 Claims, 5 Drawing Sheets

10'
14
26
58
28'
36'
20
80
90
88a
88
88c
88b
16
24
22
82b
82
15
82a
84
36'a
40'
92
84b
84a
94
86

ONE-BOATER WATERCRAFT

FIELD OF THE INVENTION

The present invention relates to a one-boater watercraft designed to be propelled by a double paddle.

BACKGROUND OF THE INVENTION

The conventional kayak type boat in which the boater sits in a seat generally enclosed within the hull with his lower limbs extending practically completely within the hull, is popular only amongst a small segment of the population, namely: the good sportsman who is a good swimmer and not afraid to stay a few minutes under water and extricate himself from the kayak in the event of kayak overturning.

Such a kayak is disclosed in the present invention on prior Canadian Patent number 1, 084,347 issued Aug. 26, 1980 and entitled: KAYAK.

OBJECTS OF THE INVENTION

It is the general object of the present invention to provide a watercraft designed for use by one boater and to be propelled by a double paddle or double-bladed oar, the watercraft having a fully-open cockpit with no obstruction preventing immediate leave of the boat by the boater in the event of watercraft capsize, the boat further including lateral stabilizers to limit the possibility of capsizing.

Another object of the present invention is to provide a watercraft of the character described, in which the cockpit is designed for holding the boater in a very comfortable manner, with his lower limbs in half-inclined folded position, and yet the cockpit providing lateral confinement for the feet and legs to enable proper handling of the double paddle especially during steering.

Another object of the project invention is to provide a watercraft of the character described, provided with a high back-rest for comfortable seating and with paddle supports and drinking cup supports as well as equipment storage areas.

Another object of the invention is to provide a watercraft of the character described, which can be molded out of plastic material in one piece by rotary molding process to obtain a watercraft of inexpensive construction.

A further object of the invention is to provide such a watercraft with a retractable back rest extension about the rear of the cockpit thereof, for still increased comfort of the user in either a paddling position or a stable, water-floating rest position.

SUMMARY OF THE INVENTION

The one-boater watercraft is designed to be propelled by a double paddle and comprises a hull molded in one piece, with its central portion tapering forward and aft into pointed bow and stern portions, the hull being hollow and with a fully-open cockpit in said central portion. The cockpit has lateral walls, a back wall, which is downwardly and forwardly inclined, followed by a seat portion followed by an inverted V-shape portion for supporting the boater's thighs and legs with a rounded apex portion for engaging under the knees. The V-shape portion joins at its forward end with a foot-rest which is upwardly forwardly inclined and joins with the hull top wall. The forward section of the V-shape portion, that is, forwardly of the apex, is formed with a longitudinal rib located centrally of the cockpit and upwardly projecting from said forward section and also rearwardly projecting from the foot-rest. The rib is adapted to extend between the boater's legs and feet and the rib at said foot-rest serves, with the lateral walls, to laterally confined the boaster's feet to provide thrust means when making a turn during paddling. The back-rest preferably exends at a higher level than the cockpit lateral walls for the comfort of the boater while allowing lateral clearance for the boater's arms during paddling. The boat is provided with lateral stabilizing bulges, having a generally flat top face. Paddling supports upstand from one bulge top face to support the paddle when not in use. The apex is preferably centrally provided with a recess to support a drinking bottle or the like. A well may be formed in the top wall rearwardly of the back-rest for storing small articles. The bottom of the well may have a hole normally closed in a watertight manner by a plug. The hole is to gain access to the hull interior, so that an inflatable bag can be inserted through said hole to extend between the cockpit bottom and the bottom wall of the hull to aid, when inflated, to support the load carried by the cockpit.

In a second embodiment, there is further provided a hollow, closed, cross-sectionally triangularly-shaped flap member, associated with said cockpit, and hinge means, hingedly connecting one corner edge section of said triangle to the rearmost edge portion of said cockpit flooring rear section for pivotal motion about an axis transverse to the watercraft longitudinal axis between a first limit position, in which said flap member is engaged into said cockpit, and a second limit alternate position, in which said flap member is completely removed from the cockpit and abuts against the top wall of said stern portion of the watercraft, said flap member defining a first wall, constituting a back-rest in said first-pivoted position thereof, and a second wall, constituting a head-rest in said second pivoted position thereof wherein in this latter case, said cockpit flooring rear section constitutes a back-rest.

DETAILED DESCRIPTION OF THE PREFERRED EMBODIMENT

Figure 1:
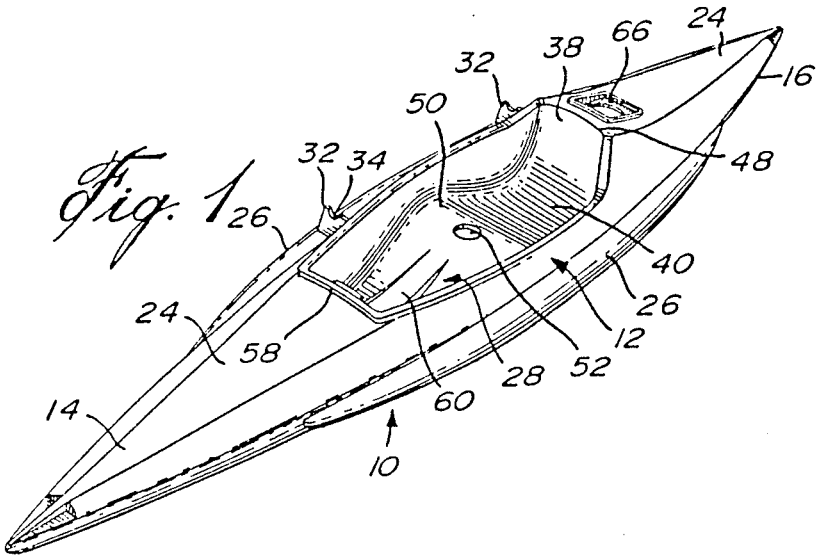
FIG. 1 is a perspective view of the watercraft.
Figure 2:
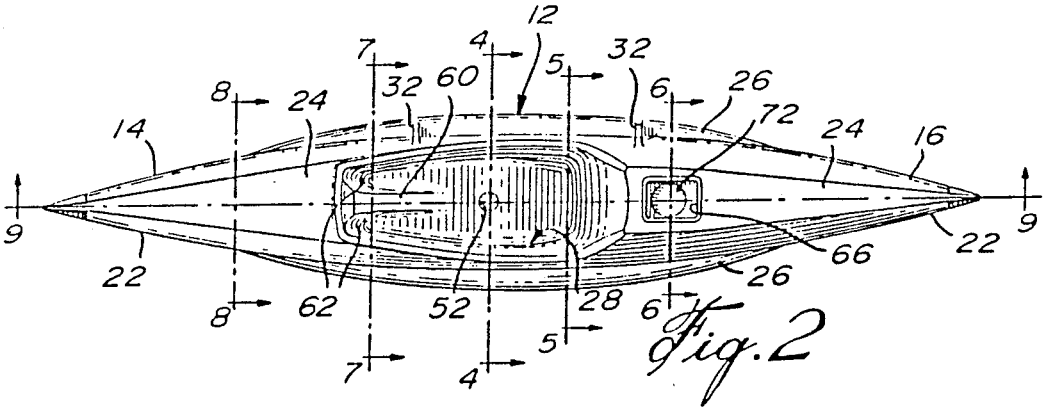
FIG. 2 is a top plan view thereof.

In the drawings, like reference characters indicate like elements throughout.

The watercraft of the invention is formed by a hull 10 molded, for instance, out of polyethylene, in a rotary molding machine. The hull 10 forms a central widest portion 12 tapering fore and aft into pointed bow and stern portions 14 and 16, respectively.

Hull 10 has a transversely-rounded bottom wall 18 formed with three parallel, longitudinally-extending guiding ribs 20. The hull has lateral walls 22 and a top wall 24. The lateral walls 22 form elongated floatation bulges 26 to provide lateral stability for the hull to decrease the possibility of capsizing. The bulges 26 extend on each side of the central portion 22 and gradually taper at both ends to merge with the lateral walls 22. The hull is provided with a fully-open cockpit 28, made in the central portion 22, and depending from the top wall 24, being surrounded by said top wall. The bulges 26 extend rearwardly and forwardly of the cockpit 28. The top faces 30 of the bulges 26 are generally flat and one top face 30 is formed with a pair of longitudinally spaced double paddle supports 32 for holding a double paddle in horizontal position on the bulge 26 when this paddle is not in use. Each support 32 has a top notch 34 receiving the stem of the double paddle.

Figure 4:
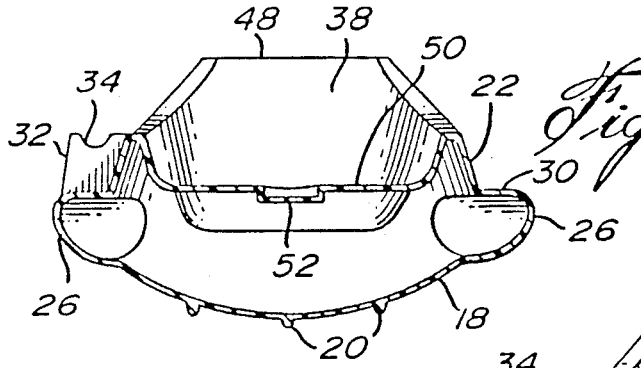
FIG. 4 to 8 are enlarged cross-sections taken along line 4—4 to 8—8 of FIG. 2, respectively.
Figure 5:
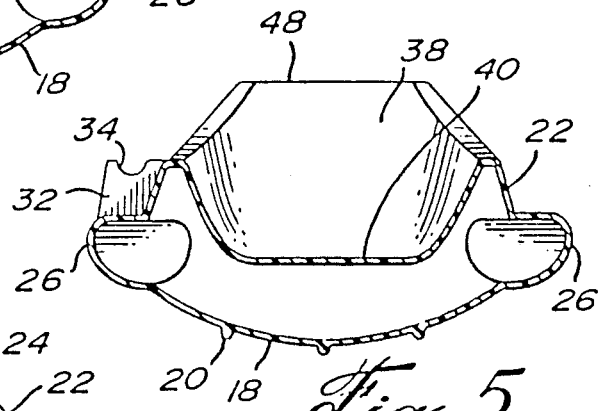
Figure 6:
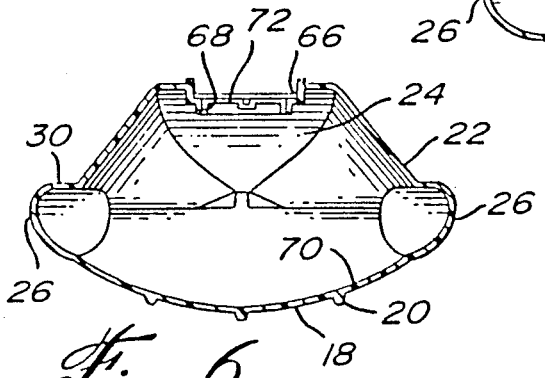
Figure 7:
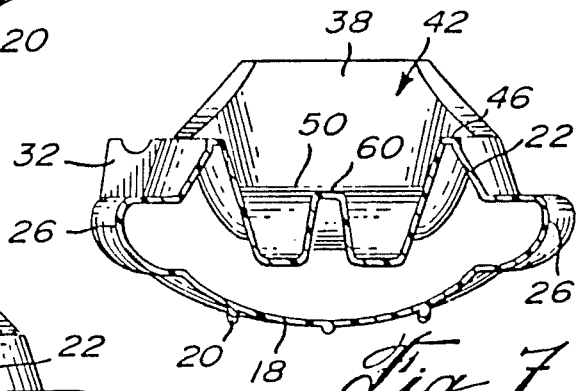
Figure 8:
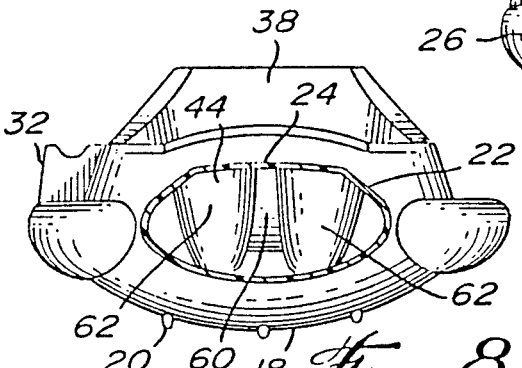

In accordance with a main feature of the present invention, the cockpit 28, which is fully open, is defined by a pair of lateral walls 36, a back wall serving as a back-rest 38, a seat portion 40 followed by an inverted portion 42, in turn followed by an upwardly, forwardly-inclined foot-rest 44. The lateral walls 36 are downwardly converging and generally straight in cross-section. They merge at their top end with the top wall 24 of the hull, as shown by the generally horizontal and straight junction line 46. The top of the back-rest 38 merges with the top wall 24 along a tranverse junction line 48, which is higher than the junction line 46. The V-shape portion 42 has an apex 50 provided with a central circular recess 52 for holding a drinking bottle, a drinking cup or the like. The rear section 54 of the V-shape apex portion 42, that is the section extending between the seat 40 and the apex 50, is forwardly, upwardly inclined from seat portion 40 and is designed to support the boater's thighs in upwardly-inclined position. The apex portion 50 is rounded and is adapted to extend under the boater's knees. The front section 56 of V-shape portion 42 is forwardly, downwardly inclined and is designed to support the boater's legs in downwardly-inclined position. The front section 56 merges with the lower edge of the foot-rest 44. This foot-rest is upwardly, forwardly inclined and joins with the top wall 24 along a transverse junction line 58, which is slightly above the junction line 46. A central, longitudinally-extending rib 60 upwardly extends from the front section 56 and rearwardly protrudes from the foot-rest 44. The rib 60 gradually rearwardly merges with the front sections 56, so that the apex 50 is substantially straight transversely of the boat, as shown in FIG. 4, except for the recess 52. The rib 60 extends between the boater's legs and separates the foot-rest 44 into two foot-rest sections 62, each laterally confining a boater's foot in conjunction with the adjacent lateral wall 36 of the cockpit 28. Thus, the rib 60 and these lateral walls provide reaction surfaces for the wearer's feet and the adjacent portion of the legs to enable relatively easy steering of the watercraft by the boater during paddling.

Figure 3:
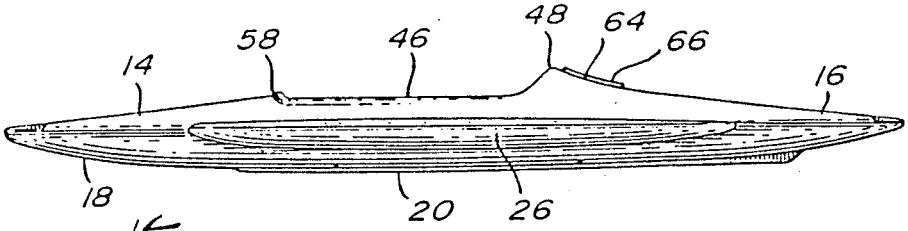
FIG. 3 is a side elevation thereof.

In order to provide as high a back-rest as possible for the boater's comfort while keeping the general profile of the boat as low as possible, the half-deck portion of the boat immediately rearwardly of the back-rest is concave, as shown at 64 in FIG. 3. In this concave portion 64, there is formed a general rectangular well 66 for accomodating various articles. The well 66 is provided at its bottom with an access hole 68 to gain access to the interior 70 of the hull. This hole 68 is normally closed in watertight manner by a screwed closure plug 72.

An inflatable bag 74, when deflated, is inserted within the hull interior 70 through the hole 68 and is positioned between the hull bottom wall 18 and the bottom wall of the cockpit formed by the seat portion 40 and the V-shape portion 42. The bag is then inflated through a nipple 76 accessible at the hole 68. The bag, when inflated, is at least co-extensive with the above-defined bottom portion of the cockpit and preferably extends around each cockpit lateral wall and the back-rest 38 and foot-rest 48. The bag 74 is made of non-stretchable but air-proof fabric, for instance a vinyl-coated nylon fabric. The bag, when inflated, prevents collapse of the top wall and cockpit under the load carried by the cockpit.

Figure 9:
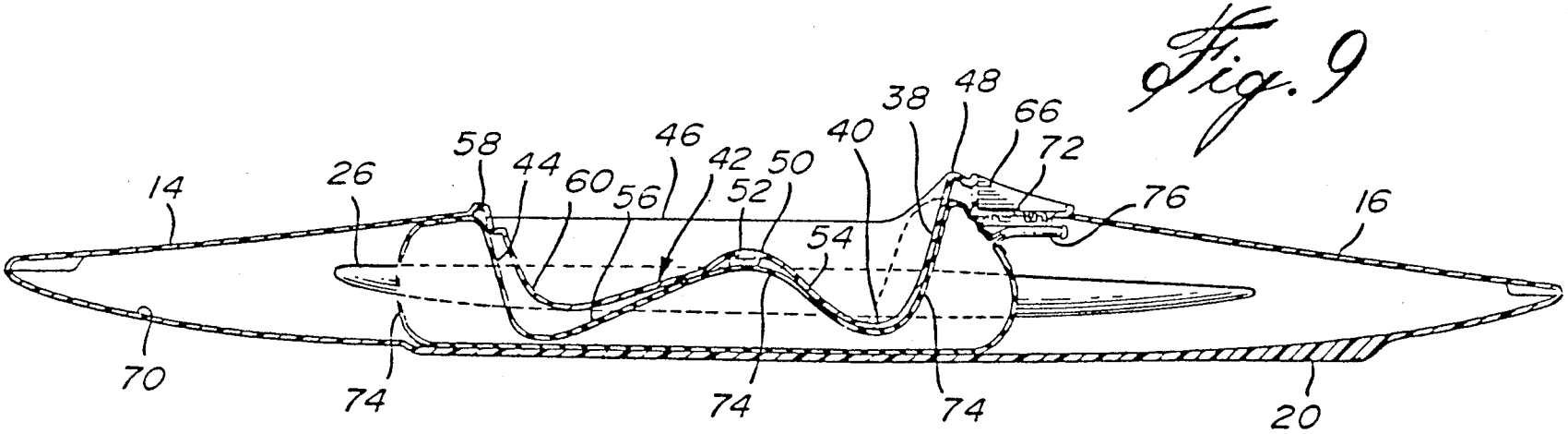
FIG. 9 is an enlarged longitudinal section taken along line 9—9 of FIG. 2.
Figure 10:
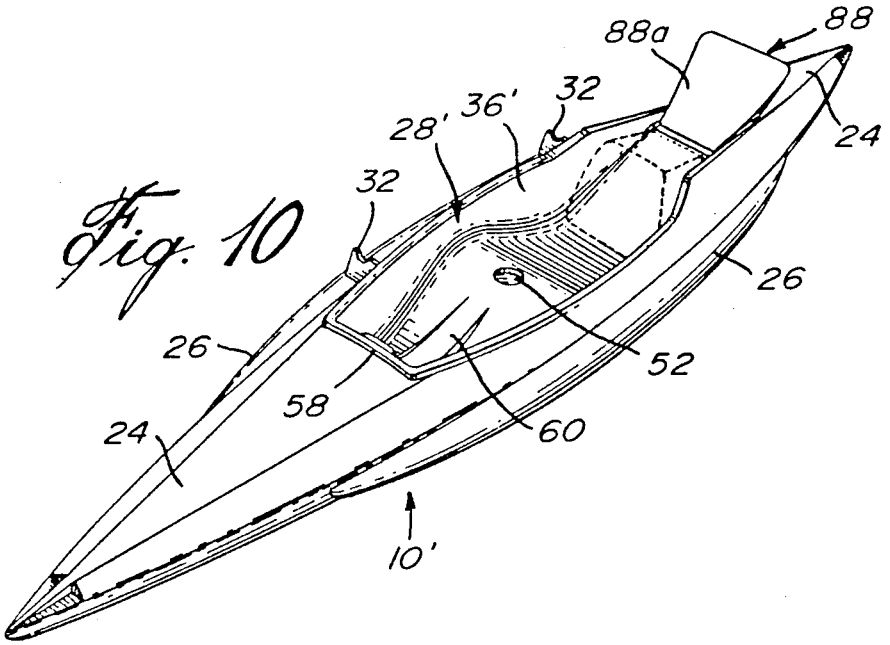
FIG. 10 is perspective view of the watercraft provided with a back-rest extension means according to an alternate embodiment of the invention.
Figure 11:
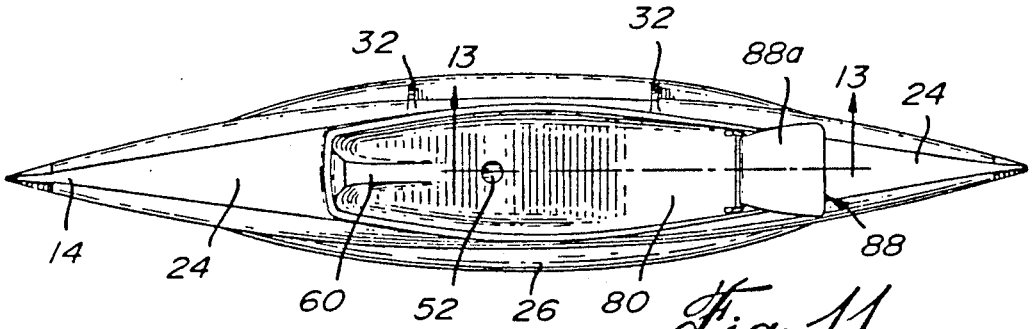
FIG. 11 is a top plan view of the watercraft of FIG. 10.
Figure 12:
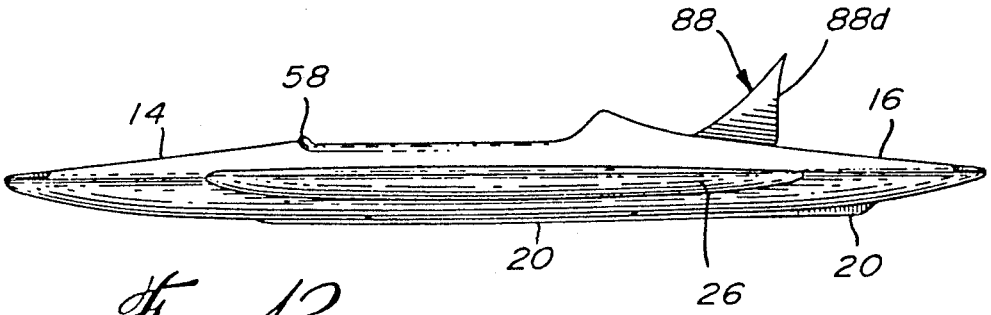
FIG. 12 is a side edge view thereof.

In an alternate embodiment of watercraft shown at 10' in FIGS. 10–15, some modifications have been brought to the cockpit 28, but the remainder of the boat remains substantially unchanged. More particularly, the inner volume of the cockpit 28' is increased by rearwardly caving the prior back-rest section 38 so as to constitute a substantially planar extension 80 of the seat portion 40' of the cockpit flooring. Indeed, comparison of corresponding FIGS. 9 and 13 clearly shows that the slope of prior back-rest 38 has been substantially reduced with back-rest 80, yet the latter will still merge along a tranverse junction with the top wall 24 of the stern portion 16 of the watercraft 10'. The slope of back-rest 80 may be of about 30 degrees with respect to the lengthwise axis of the boat 10'.

Figures 13, 14, 15:
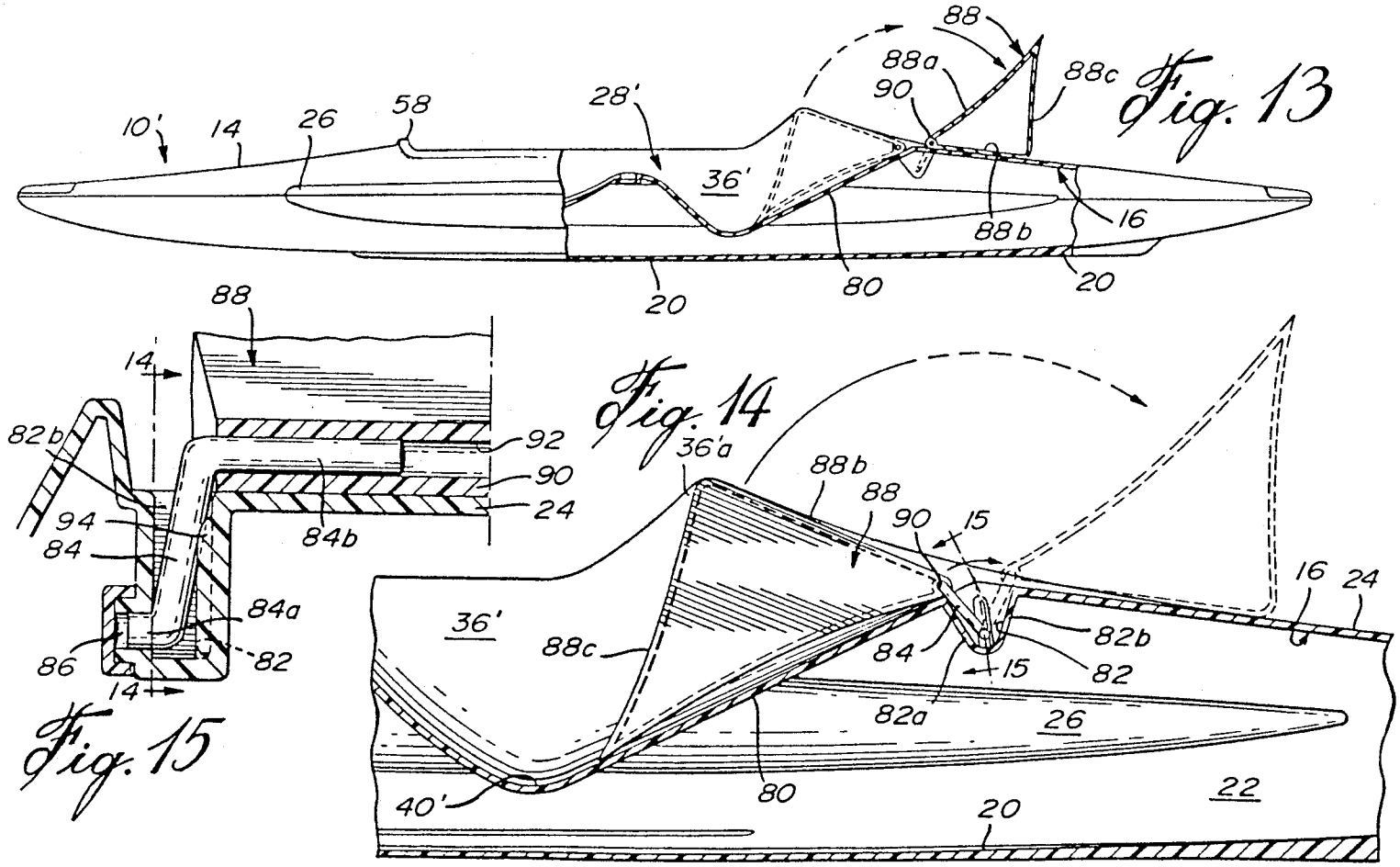
FIG. 13 is an enlarged, partly sectional, side edge view taken on line 13—13 of FIG. 11, showing the two possible alternate positions of the back-rest extension means.
FIG. 14 is an enlarged view of the backrest portion taken from the intermediate to rear section of FIG. 13, and also taken along line 14—14 of FIG. 15.
FIG. 15 is a cross-sectional view, at an enlarged scale, of the backrest hinge means, taken along line 15—15 of FIG. 14.

Two small transverslely spaced cavities 82 are made into the merging section of walls 80 and 24; cavities 82 extend downwardly into the hollow of the boat 10' but do not communicate therewith. Into each cavity 82 is lodged a cross-sectionally-circular hinge rod 84, as illustrated in FIGS. 14–15. The transversely outer wall (with respect to the longitudinal central axis of the boat 10') of each cavity 82 includes a transverse bottom chamber 86 of circular shape, rotatably engaged by an elbowed, bottom, short extension **84*a* of rod 84. The opposite end of each rod 84 is also elbowed to constitute an elongated extension 84*b* projecting in a direction opposite that of extension 84*a*. As shown in FIG. 14, each cavity 82 has upwardly diverging front and back walls 82*a*, 82*b* against which the main section or hinge rod 84 alternately abuts when pivoting about its bottom 84*a*** extension.

A hollow, cross-sectionally right triangular shape, flap member 88, is pivotally retained to the hull by the two hinge rods 84. Flap member 88 defines a main wall **88*a*, two opposite walls 88*b*, 88*c* and two opposite lateral walls 88*d*. The flap edge 90 about which merge walls 88*a* and 88*b*, defines a cylindrical through-channel 92 at both end sections of which are rotatably engaged the two corresponding hinge rod extensions 84*b*. Thus, flap 88 is pivotable about hinges 84 and these hinges are in turn pivotable relative to the hull. Flap 88 is therefore longitudinally shiftable and pivotable between a first position, engaged into cockpit 28', and a second position, abutting against the stern portion top wall 24 exteriorly of the cockpit, as illustrated in full lines and in dotted lines respectively in FIG. 14. More specifically, in its first limit position, flap 88 fits completely within cockpit 28', with its main wall 88***a* applied against cockpit section 80 and with its side walls 88*d*, in spaced register with the cockpit side walls 36', the latter having an uppermost section 36'*a* then registering with the merging edge section of the flap walls 88*b* and 88*c*. In its second limit position, flap 88 abuts against the stern portion top wall 24 by its wall 88*b*, and accordingly, the latter should be flat.

Hence, in the first flap section, flap wall 88*c* serves as a back-rest at an inclination corresponding to that of back-rest 38 of the first embodiment; while flap wall 88*a* in the second flap position, serves as a head-rest, substantially coextensive with the back-rest portion 80; accordingly, flap walls 88*a*, 88*c* are preferably very slightly concave, as suggested in FIG. 14, for the comfort of the user. Forward and rearward shifting of flap 88 permits the latter to clear the transverse junction of walls 80 and 24.

Preferably, as illustrated in FIG. 15, small obtuse angles are defined between hinge rod sections 84–84*a* and 84–84*b*, respectively, wherein the rod extensions 84*a*, 84*b* are transversely offset so that a frictional interference be obtained by hinge rods 84 with small projection 94 on the inner wall of each cavity 82, interiorly thereof. This projection 94 releasably maintains hinge 84 in either one of its two pivoted positions about its lower pivot 84*a*.

The watercraft, with its inflated bag, is of very light weight, so that it can be easily carried. When propelled, the boat easily follows a straight line due to its guiding ribs 20. Although the bulges 26 act as very effective stabilizing means to prevent capsizing, if the boat capsizes, the boater will be free to eject from the boat without any obstruction.

The boater, when not paddling, comfortably sits within the cockpit as in a garden reclining chair, with the double paddle conveniently being supported on the paddle supports 32.

The resulting watercraft is therefore designed to attract a segment of the population who, even if they are not good swimmers and of the sporting type, will enjoy leisurely floating on a lake and yet be able to propel the boat with a minimum of effort and at a relatively fast pace.

I claim:

1. A one-boater watercraft to be propelled by a double paddle, comprising: a hull molded in one piece with a central portion tapering forward and aft into pointed bow and stern portions, said hull being hollow and defining a top wall, a bottom wall and side walls joining said top and bottom walls, said side walls at said central portion outwardly protruding to form elongated bulges, a fully-open cockpit surrounded by and depending from said top wall and located in said central portion, said top wall forming fore and aft deck portions relative to said cockpit, said cockpit defined by a pair of lateral walls, by a back wall downwardly, forwardly inclined from said aft deck portion, followed by a seat portion followed by an inverted V-shape portion for supporting the boaster's thighs and legs with a rounded apex portion for engaging under the knees, said V-shape portion joining at its forward end with a foot-rest which is upwardly forwardly inclined and joins said fore deck portion at its top end, said V-shape portion including a forward section located forwardly of said apex portion, said hull further including a longitudinal rib located centrally of said cockpit and upwardly projecting from said forward section and rearwardly projecting from said foot-rest, said rib adapted to extend between the boater's legs and feet, said rib at said foot-rest serving with said cockpit lateral walls to laterally confined the boater's feet; said elongated bulges exending on each side of said cockpit fore and aft of the latter and gradually merging with the hull side walls; wherein said bulges form a top generally flat face on each side of said cockpit.

2. A watercraft as defined in claim 1, further including a pair of longitudinally-spaced double paddle supports upstanding from the top face of one of said bulges to support a double paddle horizontally along said one bulge.

3. A one-boater watercraft to be propelled by a double paddle, comprising: a hull molded in one piece with a central portion tapering forward and aft into pointed bow and stern portions, said hull being hollow and defining a top wall, a bottom wall and side walls joining said top and bottom walls, said side walls at said central portion outwardly protruding to form elongated bulges, a fully-open cockpit surrounded by and depending from said top wall and located in said central portion, said top wall forming fore and aft deck portions relative to said cockpit, said cockpit defined by a pair of lateral walls, by a flooring extending between said cockpit lateral walls and merging therewith and also merging at its front and rear ends with said top wall of the bow and stern portions respectively of the watercraft, said flooring defining a rear section, which is upwardly rearwardly inclined by an angular value relative to the lengthwise axis of said watercraft which is clearly less than half a right angle, followed by a seat portion followed by an inverted V-shape portion for supporting the boater's thighs and legs with a rounded apex portion for engaging under the knees, said V-shape portion joining at its forward end with a front foot-rest which is upwardly forwardly inclined and joins said fore deck portion at its top end, said V-shape portion including a forward section located forwardly of said apex; further including a hollow, closed, cross-sectionally triangularly-shaped flap member, associated with said cockpit, and hinge means, hingedly connecting one corner edge section of said triangle to the rearmost edge portion of said cockpit flooring rear section for pivotal motion about an axis transverse to the watercraft longitudinal axis between a first limit position, in which said flap member is engaged into said cockpit, and a second limit alternate position, in which said flap member is completely removed from the cockpit and abuts against the top wall of said stern portion of the watercraft; said flap member defining a first wall, constituting a back-rest in said first pivoted position thereof, and a second wall, constituting a head-rest in said second pivoted position thereof wherein in this latter case, said cockpit flooring rear section constitutes a back-rest; said hull further including a longitudinal rib located centrally of said cockpit and upwardly projecting from said forward section and rearwardly projecting from said foot-rest, said rib adapted to extend between the boater's legs and feet, said rib at said foot-rest serving with said cockpit lateral walls to laterally confine the boater's feet.

4. A watercraft as in claim 3, where in said flap member first and second walls are slightly concave, for comfort of the user's back and head.

5. A watercraft as in claim 3, wherein said hinge means include elongated hinge members having one end pivoted to said hull and an opposite end pivoted to said flap member and further including releasable retaining means, formed by said hull and engageable with said hinge member, for releasably maintaining the latter in either one of a forwardly pivoted limit position and of a rearwardly pivoted limit position.

6. A watercraft as in claim 3, wherein, in said flap member first limit position, said flap member second wall is upwardly rearwardly inclined by an angular value relative to the lengthwise axis of said watercraft which is clearly more than half a right angle.

7. A watercraft as in claim 4, wherein, in said flap member second limit position, said flap member second wall is substantially co-extensive with said flooring rear section.

* * * * *